United States Patent [19]

Snaddon

[11] 4,442,135

[45] Apr. 10, 1984

[54] METHOD FOR COATING WITH AN ATOMIZABLE MATERIAL

[75] Inventor: Robert W. L. Snaddon, Burnt Hills, N.Y.

[73] Assignee: General Electric Company, Schenectady, N.Y.

[21] Appl. No.: 345,510

[22] Filed: Feb. 3, 1982

[51] Int. Cl.[3] ..... B05D 4/02; B05D 4/06; B05B 3/10; B05B 5/04

[52] U.S. Cl. ..... 427/31; 427/236; 427/240; 427/421; 427/427

[58] Field of Search ..... 427/31, 27, 236, 421, 427/427, 240

[56] References Cited

U.S. PATENT DOCUMENTS 4,013,804 3/1977 Gruetzman ..... 427/27
4,215,818 8/1980 Hopkinson ..... 427/31

FOREIGN PATENT DOCUMENTS 386681 9/1973 U.S.S.R. .

OTHER PUBLICATIONS

The Condensed Chemical Dictionary, 7th Ed., Van Nostrand Reinhold Co. N.Y. ©1966.

J. O. Hinze & H. Milborn, "Atomization of Liquids by Means of a Rotating Cup", Journal of Applied Mechanics, Jun. 1950, pp. 145–153.

N. Dombrowsky & T. L. Lloyd, "Atomization of Liquids by Spinning Cups", The Chemical Engineering Journal, 8(1974) pp. 63–81.

*Primary Examiner*—Michael R. Lusignan
*Assistant Examiner*—Richard Bueker
*Attorney, Agent, or Firm*—Paul J. Checkovich; James C. Davis, Jr.; Bernard J. Lacomis

[57] ABSTRACT

Material comprising particulate matter is atomized and coated on a surface of an object by delivering the material to a surface of a spinning atomizer from a non-rotating delivery means preferably situated within the volume defined by the atomizer. The material is atomized by being thrust from the atomizer surface and at least a portion of the atomized material impacts the surface being coated. The method is particularly applicable to coating surfaces wherein abrasive material is atomized, since a seal between the non-rotating delivery means and atomizer is not needed, and wherein space limitations are imposed on the configuration of the atomizer. Further, a potential difference may be established between the atomized material and surface to be coated whereby an axial flow of material from the surface of the atomizer may be effected.

13 Claims, 2 Drawing Figures

METHOD FOR COATING WITH AN ATOMIZABLE MATERIAL

RELATED APPLICATIONS

This invention relates to my co-pending application entitled, "Seal-Free Rotating Atomizer", Ser. No. 345,509, filed currently herewith and incorporated herein by reference and to co-pending application entitled "Apparatus and Method For Coating With An Atomizable Material", Ser. No. 345,508, filed concurrently herewith and both assigned to the same assignee as hereof.

BACKGROUND OF THE INVENTION

This invention relates to a method for coating a surface with an atomizable material. More specifically, it relates to a method for providing a uniform coating of a material containing particulate matter entrained therein, as for instance a slurry. A slurry comprises solid particles in a liquid wherein the solids fraction is reasonably high, i.e. has a significant effect on the flow dynamics of the liquid.

In a known configuration, as shown in FIG. 1 of my above-identified co-pending application Ser. No. 345,509, the material to be atomized is fed to a surface of a rotating disk assembly through a passageway. The walls of the passageway are generally an integral part of the rotating disk assembly and rotate with it. Thus a rotation or swirl is imparted to the material as it flows through the passageway. A seal is required to interface between the rotating portion of the apparatus and the non-rotating source of the material to be atomized. If this material, as in the case of a slurry, contains particulate matter, then the seal is subject to wear and abrasion from the particulate matter, especially if a high speed of rotation, e.g. greater than 20,000 RPM, is required. Also, the swirling induced in the material may cause surface waves at the receiving surface of the rotating disk, thus causing an uneven flow of material across the surface of the disk with a resulting loss of uniformity of size of the droplets formed. Further, if the material contains particulate matter, forces induced in the passageway may cause the particulate matter to selectively segregate, especially where the particulate matter comprises particles having different densities and shapes, thus destroying the uniform mix of the material.

In another known configuration, as shown in FIG. 2 of my above identified co-pending application Ser. No. 345,509, the material to be atomized is delivered to a surface of a rotating disk from a direction which is on the opposite side of the disk from the drive means. Thus at least a portion of the material delivery means is located generally in the path of droplets moving axially away from the surface of the rotating disk. In certain applications, it is desirable that the droplets move axially away from the rotating surface and in these cases such positioning of the delivery means would interfere with this flow of the droplets. Also, geometric and space considerations may limit such positioning of the delivery means.

SUMMARY OF THE INVENTION

One object of the present invention is to provide a method for coating a surface with particulate laden material using a spinning atomizer, whereby particle distribution and uniformity are maintained.

Another object is to provide a method for coating the surface of an object situated axially with respect to a spinning atomizer.

Another object is to provide a method for coating the interior of a closed surface, such as that of a hollow cylinder or sphere, with a particulate laden material using a spinning atomizer.

Another object is to provide a method for coating a surface with an abrasive particulate laden material.

Another object is to provide a method for coating an object using a spinning atomizer wherein surface waves on the atomizer are minimized.

In accordance with the present invention, a method for coating a surface of an object with an atomizable material including particulate matter comprises delivering the material from a source thereof to a surface of a rotatable atomizer adapted to receive the material, the surface of the atomizer rotating with the atomizer, positioning material delivery means spaced from said atomizer, positioning the material delivery means in relation to the source such that neither the delivery means nor the source is impacted by material moving axially away from the surface of the atomizer, shaping the surface of the atomizer such that the material is directed away from the space between the atomizer and the material delivery means and rotating the atomizer at a predetermined angular velocity in order to force the material from the surface of the atomizer.

The features of the invention believed to be novel are set forth with particularity in the appended claims. The invention itself, however, both as to organization and method of operation, together with further objects and advantages thereof, may best be understood by reference to the detailed description taken in connection with the accompanying drawing.

DETAILED DESCRIPTION

Figure 1:
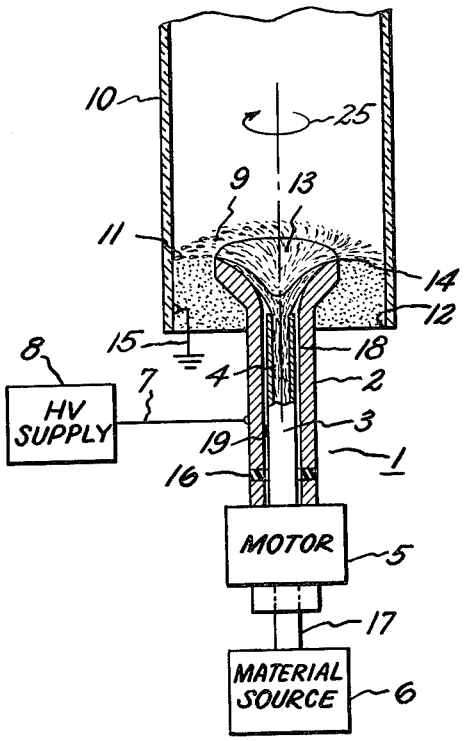
FIGS. 1 and 2 are part schematic and part cut away views illustrating apparatus for practicing two embodiments, respectively, of the present invention.

Illustrated in FIG. 1 is an embodiment for practicing the present invention. Although the present invention is particularly useful where a material 4 being atomized comprises particulate matter entrained in a carrier fluid, as in a slurry, and especially where the particulate matter is abrasive, it is to be understood that other forms of material, as for instance a liquid, may be used.

A brief description of a spinning atomizer 1, which is more fully described in my above-identified copending application Ser. No. 345,509 and which is herein incorporated by reference, will be provided for a better understanding of the invention. The atomizer 1 comprises a rotatable member 2 having a surface 13 for receiving the material 4 to be atomized, driving means 5 such as a motor or air-turbine, for rotating the member 2, and non-rotating fluid-communicating means 3, such as a conduit, for delivering the material 4 to the surface 13. The material 4, which may typically be a phosphor slurry, is delivered from a source 6 thereof, to the conduit 3 by a connecting means 17 which permits flow communication between the conduit 3 and the source 6. Further, the conduit 3 is situated outside the axial flow path of material 4 leaving the surface 13, preferably within the interior volume or channel 18 defined by the member 2, and is preferably co-axial or concentric with the axis of rotation 25 of the member 2.

Lack of any need for a seal, which was generally required in conventional apparatus to enclose the space between a rotating and a non-rotating element, between either the non-rotating source 6 and the rotating member 2, or between the stationary delivery conduit 3 and the rotating member 2, makes the invention especially advantageous for atomizing a material having a relatively high particulate content, as for instance a slurry, since a seal is often subject to damage by abrasion from the particulate matter. Also, a seal generally will cause the vibration of the member to increase, especially at high speeds, because of forces acting on the seal, e.g. friction. Vibration is undesirable because it is another source of surface instability which may cause surface waves to form. Further, a rotating delivery means may cause particulate matter entrained in the material 4 to selectively segregate, especially where the particles are of different densities and shapes, thus destroying the uniform mix of the material 4 from the source 6.

In operation, as illustrated in FIG. 1, the material 4 to be atomized is delivered to the rotating member 2 at surface 13 adapted to receive the material. The delivery means includes conduit 3 which is non-rotating. The member 2 is rotated at a predetermined angular velocity in order to fling or thrust the material 4 from the surface 13. The angular velocity is preferably sufficient to cause the material 4 to be sheared into droplets 9 at the edge 14 of the surface 13. The average size of the droplets 9 tends to be inversely proportional to the angular velocity of the member 2, that is, a higher angular velocity will generally yield smaller sized droplets 9.

The material 4 is delivered substantially uniformly about the axis of rotation 25 of surface 13 and preferably delivered to the surface 13 at the axis of rotation 25 of the surface 13 whereat the tangential forces acting on the material are minimal, thereby helping to minimize or altogether eliminate surface waves on the material 4 as it is forced over the surface 13 to the edge 14 thereof. Minimization of surface waves results in formation of more uniform-sized droplets 9, which permits the application of a coating of material 4 to be more uniform and easier to control than if the droplets were of non-uniform size.

Although the contour of the surface 13 may assume many shapes which will impart the desired axial and radial force components to the material 4 as it leaves the conduit 3, only one, a bell shape, will be herein described. The material 4 to be atomized is delivered in the region of the truncated apex of surface 13, and droplet 9 formation occurs at the edge or tail 14 of surface 13. Specific axial and radial force components are necessary in order that the material 4 travel over the surface 13 to the edge 14 thereof to form droplets 9 and to prevent the material from entering the region 19 between the channel 18 wall and the outer wall of the conduit 3, permitting atomizer 1 to be operated with a substantially vertical orientation having the surface 13 facing upwardly.

The surface 11 of an object 10 to be coated is situated so as to be impacted by at least a portion of the material or droplets 9 thrown from the surface 13 of the member 2. The surface 11 of object 10 may be of any shape; however, the invention may especially be advantageously used to coat the interior surface of a closed object, such as a hollow sphere, cube or cylinder, wherein space or geometrical limitations on the method employed are imposed, since the motor 5 and the material delivery means 3 would not interfere with the flow of droplets 9 from the surface 13 and would not hinder the positioning of the member 2 and surface 13 thereof within the volume defined by the surface to be coated. A hole or aperture may be provided through such objects, as required, to permit the member 2 and surface 13 thereof to be positioned within the hollow of the object whereby the interior surface of the object may be contacted with and coated by droplets 9. Further, the member 2 may be elongated to any desired length to permit the member 2 and surface 13 thereof to be more easily positioned within such objects.

In order to improve the distribution of the coating material on the surface 11 being coated and to help direct droplets 9 of the material toward the surface 11, an electrical potential may be created between the material 4 and the surface 11. As shown in FIG. 1, a high voltage may be applied from power supply 8 through circuit means 7 to the member 2. The member 2 is preferably fabricated of an electrically conductive material. Insulation means 16, such as a non-electrically conductive zone, isolates the electrically charged portion of the member 2 from the motor 5 and associated hardware. Where the object 10 being coated is electrically conductive, the object 10 is preferably maintained at ground potential through connecting means 15, which also places the surface 11 to be coated at or near ground potential. Thus the surface 11 acts as an electrode. In this configuration the high voltage supply 8 may provide either a positive or a negative potential with respect to ground.

In a configuration not shown, the member 2 may be connected to electrical ground and the high voltage power supply may be connected to the surface of the object to be coated, allowing the surface to be maintained at either a positive or a negative potential with respect to ground.

Since the member 2 is preferably conductive, the material 4 to be atomized is electrically charged as it flows over the surface 13 thereof. The droplets 9 of material 4, formed as the material is thrust from the edge 14 of the surface 13 of the member 2, are therefore likewise charged. The difference in potential between the surface 11 to be coated and the droplets 9 causes the droplets to be attracted to, and migrate toward, the surface 11. Thus the effectiveness of the coating process is increased since droplets 9, being attracted to the surface 11, have a decreased chance that they will not impinge thereon. Further, since the droplets 9 exhibit like charges, they repel each other, decreasing the likelihood that they will overtake each other to form large globules before striking the surface 11.

Where the object 10 being coated is non-conductive, the surface 11 may have to be pre-treated in order to provide it with an electrical potential sufficient to allow it to be adequately coated. This may be accomplished by any of several methods. For example, the surface 11 may be coated with a metal or electrically conductive metal oxide, and the connection 15 made thereto before a coating of the material 4 is applied. In another case, a strip of the material 4, if conducting, may be deposited on the surface 11 at an end of the object 10 where the connecting means 15 contacts the strip. Further material 4 is then deposited adjacent to and abutting the strip of previously deposited material 4 so as to maintain electrical contact between the previously deposited material and the newly deposited material. In another case, where the surface 11 to be coated may be partially conductive, it may bepossible to increase the conductivity thereof by wetting the surface 11 with water while, if surface 11 is nonconductive, it may be made sufficiently conductive by wetting it with water so that it may be advantageously used as an electrode. In still another case, a previously deposited layer of material 4 may be used as the electrode in a multi-layer coating process.

Figure 2:
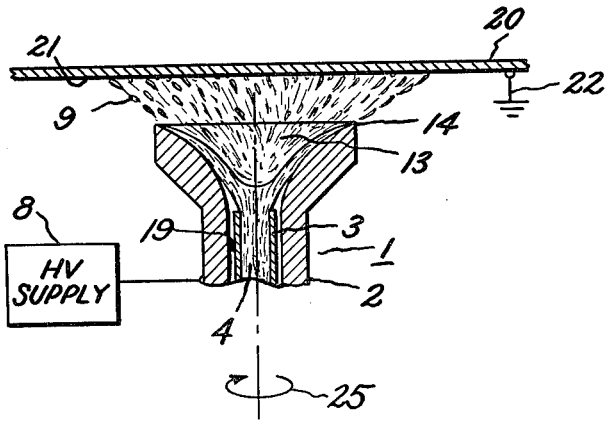

Shown in FIG. 2 is another embodiment of the present invention, with the rotating member 2 shown in partial section view and wherein the structural elements have the same function as their like numbered counterparts in FIG. 1. The surface 21 of an object 20 to be coated is connected by circuit means 22 to ground potential and the member 2 is charged to either a positive or negative potential by the high voltage supply 8 as hereinbefore explained. The surface 21 may be heated, as necessary, as hereinbefore described.

Due to the potential created on the material 4 as it traverses the surface 13, and the potential thus acquired by the droplets 9 formed as the material is forced or thrust from the surface 13, the droplets are attracted to the surface 21 to be coated. This movement is generally axially away from the rotating member 2 and surface 13 thereof. This positioning of the object 20 and coating process itself is in part made possible and facilitated by locating both the drive means (not shown) for the member 2 and delivery means 3 for the material 4 out of the axial path of the droplets 9. Where the surface 21 to be coated is relatively large, an array of atomizers 1 may be used to ensure that the entire surface area is coated and to reduce the time necessary to coat the surface. The surface 21 may be treated, as necessary, as hereinbefore described.

In the configuration of either FIG. 1 or 2, the coating with material 4 may be effected by: moving or translating the atomizer 1 while holding stationary the object 10, 20 to be coated; moving or translating the object 10, 20 while holding the atomizer 1 stationary; or moving or translating both the object 10, 20 and the atomizer so as to create relative motion therebetween.

Thus a method for coating surface with particulate laden and/or abrasive material using a spinning atomizer, whereby particle distribution and uniformity are maintained and surface waves are minimized has been illustrated and described. Further, it has been shown that the surface may be axially situated with respect to the atomizer or that the surface may be the interior of a closed object.

While only certain preferred features of the invention have been shown by way of illustration, many modifications and changes will occur to those skilled in the art. It is to be understood that the appended claims are intended to cover all such modifications and changes as fall within the true spirit and scope of the invention.

What is claimed is:

1. A method for atomizing an atomizable material including particulate matter, comprising:

a) delivering said material from a source thereof to a surface of a rotatable atomizer adapted to receive said material substantially uniformly around the axis of rotation of said surface, said surface of said atomizer rotating with said atomizer;

b) positioning material delivery means spaced from said atomizer and within the interior volume defined by said atomizer and further establishing no seal between said material delivery means and said atomizer;

c) positioning the material delivery means in relation to said source such that neither said delivery means nor said source is impacted by material moving axially away from said surface of said atomizer;

d) shaping said surface of said atomizer such that said material is directed away from the space between said atomizer and said material delivery means; and e) rotating said atomizer at a predetermined angular velocity in order to force said material from said surface of said atomizer.

2. A method as in claim 1 wherein positioning material delivery means spaced from said member includes providing a non-rotating delivery means.

3. A method as in claim 1 further comprising situating an object having a surface to be coated with said material such that said surface to be coated is impacted by at least a portion of the material forced from said surface of said atomizer.

4. A method as in claim 3 wherein the step of situating said object includes positioning said object such that the surface of said atomizer is within the volume defined by the surface to be coated.

5. A method as in claim 3 further comprising establishing an electrical potential difference between said material and said surface of said object.

6. A method as in claim 5 wherein said electrical potential difference is established by grounding said surface of said object and by applying an electrical potential to said atomizer.

7. A method as in claim 5 wherein said electrical potential difference is established by grounding said atomizer and by applying an electrical potential to said surface of said object.

8. A method as in claim 6 or 7 further comprising coating said surface of said object with an electrically conductive coating before impacting said surface of said object with the material forced from said surface of said atomizer.

9. A method as in claim 8 wherein said conductive coating comprises a metal.

10. A method as in claim 7 wherein said conductive coating comprises an electrically conductive metal oxide.

11. A method as in claim 6 or 7 further comprising the step of wetting said surface of said object with water.

12. A method as in claim 5 wherein the step of situating said object further includes positioning said object such that said surface thereof to be coated with said material is located to be impacted by at least a portion of said material moving axially away from said surface of said atomizer.

13. A method as in claim 12 further comprising providing a plurality of atomizers arranged in a pre-determined array.

* * * * *